US006920029B2

(12) United States Patent
Padroni

(10) Patent No.: US 6,920,029 B2
(45) Date of Patent: Jul. 19, 2005

(54) CONTROL METHOD FOR AN ELECTROMAGNETIC ACTUATOR FOR THE CONTROL OF A VALVE OF AN ENGINE FROM AN ABUTMENT CONDITION

(75) Inventor: Gianni Padroni, Portoferraio (IT)

(73) Assignee: Magneti Marelli Powertrain S.p.A., Turin (IT)

( * ) Notice: Subject to any disclaimer, the term of this patent is extended or adjusted under 35 U.S.C. 154(b) by 275 days.

(21) Appl. No.: 10/174,323

(22) Filed: Jun. 18, 2002

(65) Prior Publication Data

US 2003/0052763 A1 Mar. 20, 2003

(30) Foreign Application Priority Data

Jun. 19, 2001 (IT) ..... BO2001A0390

(51) Int. Cl.[7] ..... H01H 47/00
(52) U.S. Cl. ..... 361/143; 361/139
(58) Field of Search ..... 361/139, 143, 361/147, 152, 160; 251/128, 129.01, 129.1, 129.15, 129.16

(56) References Cited

U.S. PATENT DOCUMENTS

| | | | | |
|---|---|---|---|---|
| 4,544,986 A | | 10/1985 | Buchl | 361/152 |
| 4,614,170 A | | 9/1986 | Pischinger et al. | 123/90.11 |
| 5,905,625 A | | 5/1999 | Schebitz | 361/154 |
| 6,141,201 A | | 10/2000 | Schmitz | 361/154 |
| 6,332,436 B1 | * | 12/2001 | Di Lieto et al. | 123/90.11 |
| 6,371,064 B2 | * | 4/2002 | Hartke et al. | 123/90.11 |
| 6,390,037 B2 | * | 5/2002 | Di Lieto et al. | 123/90.11 |
| 6,390,113 B1 | | 5/2002 | Reif | 137/1 |
| 6,427,971 B1 | * | 8/2002 | Kawabe et al. | 251/129.04 |
| 6,671,156 B2 | * | 12/2003 | Di Lieto et al. | 361/139 |

FOREIGN PATENT DOCUMENTS

| | | | |
|---|---|---|---|
| DE | 19544207 | 6/1997 | H01F/7/01 |
| EP | 1099828 | 5/2002 | F01L/9/04 |

* cited by examiner

*Primary Examiner*—Brian Sircus
*Assistant Examiner*—Danny Nguyen
(74) *Attorney, Agent, or Firm*—Baker & Daniels

(57) ABSTRACT

A control method for an electromagnetic actuator for the control of a valve of an engine from an abutment condition, in which an actuator body actuating the valve and disposed to move between two electromagnets is maintained in abutment against a first excited electromagnet and against the action of at least one elastic body; in order to bring the actuator body into abutment against a second electromagnet, the first electromagnet is de-excited and the second electromagnet is then excited by means of excitation parameters, which are determined as a function of the measurement of the mean value of the disturbance force acting on the valve during the stage of de-excitation of the first electromagnet.

26 Claims, 2 Drawing Sheets

CONTROL METHOD FOR AN ELECTROMAGNETIC ACTUATOR FOR THE CONTROL OF A VALVE OF AN ENGINE FROM AN ABUTMENT CONDITION

The present invention relates to a control method for an electromagnetic actuator for the control of a valve of an engine.

BACKGROUND OF THE INVENTION

As is known, internal combustion engines of the type disclosed in Italian Patent Application BO99A000443 filed on 4 Aug. 1999, are currently being tested, in which the intake and exhaust valves are moved by electromagnetic actuators. These electromagnetic actuators have undoubted advantages, as they make it possible to control each valve according to a law optimised for any operating condition of the engine, while conventional mechanical actuators (typically camshafts) make it necessary to define a lift profile for the valves which represents an acceptable compromise for all the possible operating conditions of the engine.

An electromagnetic actuator for a valve of an internal combustion engine of the type described above normally comprises an actuator body, which is connected to the stem of the valve and, in rest conditions, is held by at least one spring in an intermediate position between two de-excited electromagnets; in operation, the electromagnets are controlled so as alternately to exert a force of attraction of magnetic origin on the actuator body in order to displace this actuator body between the two limit abutment positions, which correspond to a position of maximum opening and a position of closure of the respective valve.

In order to displace the valve from the position of maximum opening to the closed position or vice versa, the actuator body has to be displaced from a position of abutment against a first electromagnet to a position of abutment against a second electromagnet; for the purposes of performing this displacement, the first electromagnet is de-excited and the second electromagnet is subsequently excited with the excitation parameters, i.e. with values of intensity, duration and instant of commencement of the excitation current, depending on the engine point.

It has been observed, however, that in the known electromagnetic actuators of the type described above, the position of abutment against the second electromagnet is normally reached with a relatively high speed of impact of the actuator body against the second electromagnet, which causes both substantial mechanical stresses on the electromagnetic actuator and a high level of noise generated by the electromagnetic actuator.

In order to attempt to remedy the above-described drawbacks, it has been proposed to use an external position sensor, which provides, instant by instant, the exact position of the actuator body and makes it possible precisely to control the actual position of the actuator body; position sensors able to provide the precision and service life needed for profitable use for this purpose are not, however, commercially available.

SUMMARY OF THE INVENTION

The object of the present invention is to provide a control method for an electromagnetic actuator for the control of a valve of an engine, which is free from the above-mentioned drawbacks and, in particular, is easy and economic to embody.

The present invention therefore relates to a control method for an electromagnetic actuator for the control of a valve of an engine as claimed in claim 1.

BRIEF DESCRIPTION OF THE DRAWINGS

The present invention will be described below with reference to the accompanying drawings, which show a non-limiting embodiment thereof, in which.

DETAILED DESCRIPTION OF THE INVENTION

Figure 1:
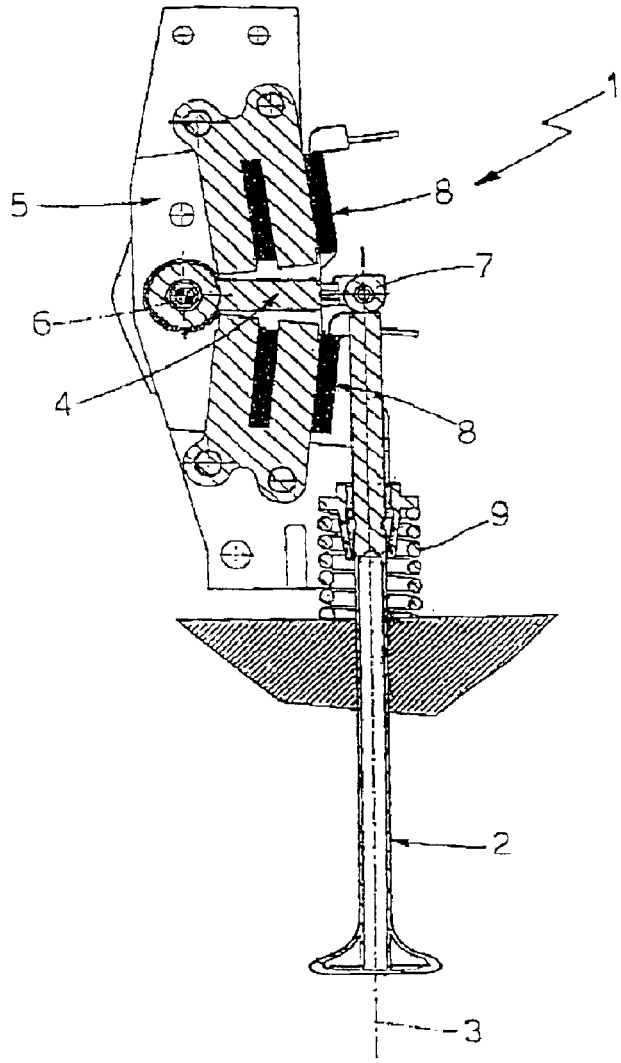
FIG. 1 is a diagrammatic view, in lateral elevation and partial cross-section, of a valve of an engine and a relative electromagnetic actuator operating according to the method of the present invention.

In FIG. 1, an electromagnetic actuator (of the type disclosed in European Patent Application EP1087110) is shown overall by 1 and is coupled to an intake or exhaust valve 2 of an internal combustion engine of known type in order to displace the valve 2 along a longitudinal axis 3 of the valve between a closed position (known and not shown) and a position of maximum opening (known and not shown).

The electromagnetic actuator 1 comprises an oscillating arm 4 made at least partly from ferromagnetic material, which has a first end hinged on a support 5 so as to be able to oscillate about an axis of rotation 6 transverse to the longitudinal axis 3 of the valve 2, and a second end connected by a hinge 7 to an upper end of the valve 2. The electromagnetic actuator 1 further comprises two electromagnets 8 borne in a fixed position by the support 5 so that they are disposed on opposite sides of the oscillating arm 4, and a spring 9 coupled to the valve 2 and adapted to maintain the oscillating arm 4 in an intermediate position (shown in FIG. 1) in which this oscillating arm 4 is equidistant from the polar expansions 10 of the two electromagnets 8. According to a different embodiment which is not shown, the spring 9 coupled to the valve 2 is flanked by a torsion bar spring coupled to the hinge disposed between the support 5 and the oscillating arm 4.

In operation, a control unit 11 controls the position of the oscillating arm 4, i.e. the position of the valve 2, in feedback and in a substantially known manner, on the basis of the engine operating conditions; the control unit 11 in particular excites the electromagnets 8 in order alternately or simultaneously to exert a force of attraction of magnetic origin on the oscillating arm 4 in order to cause it to rotate about the axis of rotation 6 thereby displacing the valve 2 along the respective longitudinal axis 3 and between the above-mentioned positions of maximum opening and closure (not shown).

As shown in FIG. 1, the valve 2 is in the above-mentioned closed position (not shown) when the oscillating arm 4 is in abutment on the excited upper electromagnet 8, is in the above-mentioned position of maximum opening (not shown) when the oscillating arm 4 is in abutment on the excited lower electromagnet 8, and is in a partially open position when both electromagnets are de-excited and the oscillating arm 4 is in the above-mentioned intermediate position (shown in FIG. 1) as a result of the force exerted by the spring 9.

Figure 2:
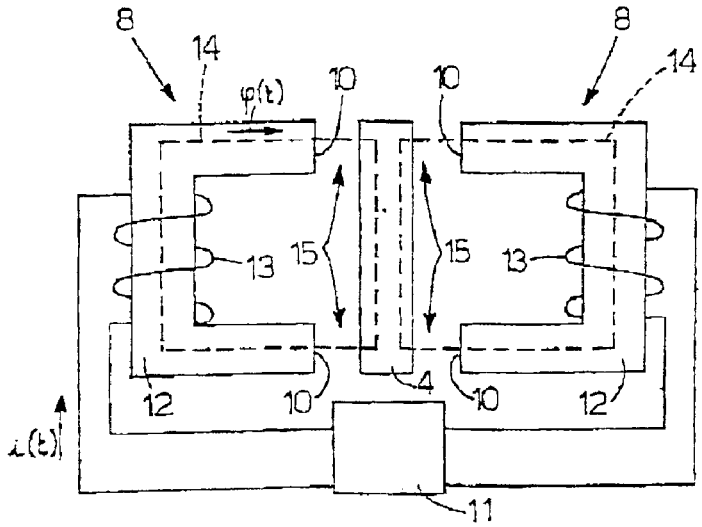
FIG. 2 is a diagram of an electromagnetic circuit of the actuator of FIG. 1.

As shown in FIG. 2, each electromagnet 8 comprises a respective magnetic core 12 coupled to a corresponding coil 13, which is supplied by the control unit 11 with a current i(t) that is variable over time in order to generate a flux Φ(t) via a respective magnetic circuit 14 coupled to the coil 13. Each magnetic circuit 14 is in particular formed by the relative core 12 of ferromagnetic material, the oscillating arm 4 of ferromagnetic material and the air gap 15 between the relative core 12 and the oscillating arm 4.

Each magnetic circuit 14 has an overall reluctance R defined by the sum of the reluctance of the iron $R_{fe}$ and the reluctance of the air gap $R_0$ (equation [2]); the value of the flux Φ(t) circulating in the magnetic circuit 14 is linked to the value of the current i(t) circulating in the relative coil 13 by equation [1], in which N is the number of turns of the coil 13:

$$N*i(t)=R*\Phi(t) \quad [1]$$

$$R=R_{fe}+R_0 \quad [2]$$

In general, the value of the overall reluctance R depends both on the position x(t) of the oscillating arm 4 (i.e. on the amplitude of the air gap 15, which is equal, less a constant, to the position x(t) of the oscillating arm 4), and on the value assumed by the flux Φ(t). Leaving aside negligible errors, i.e. as a first approximation, it can be considered that the reluctance value of the iron $R_{fe}$ depends only on the value assumed by the flux Φ(t), while the value of the reluctance of the air gap $R_0$ depends only on the position x(t), i.e.:

$$R(x(t), \Phi(t))=R_{fe}(\Phi(t))+R_0(x(t)) \quad [3]$$

$$N*i(t)=R(x(t), \Phi(t))*\Phi(t) \quad [4]$$

$$N*i(t)=R_{fe}(\Phi(t))*\Phi(t)+R_0(x(t))*\Phi(t) \quad [5]$$

$$N*i(t)=H_{fe}(\Phi(t))+R_0(x(t))*\Phi(t) \quad [6]$$

$$R_0(x(t))=(N*i(t)-H_{fe}(\Phi(t)))/\Phi(t) \quad [7]$$

It is then clear from equation [7] that it is possible to calculate the value assumed by the reluctance of the air gap $R_0$, and therefore the position x(t) of the oscillating arm 4, when the value assumed by the flux Φ(t) and the value assumed by the current i(t) are known; in particular, once the value assumed by the reluctance of the air gap $R_0$ has been calculated, it is relatively simple to obtain the position x(t) of the oscillating arm 4 as the structural properties of the magnetic circuits 14 are known.

The relationship between the air gap reluctance $R_0$ and the position x can be obtained relatively simply by analysing the characteristics of the magnetic circuit 14 (an example of a behavioural model of the air gap 15 is shown in equation [9] below). Once the relationship between the air gap reluctance $R_0$ and the position x is known, the position x can be obtained from the air gap reluctance $R_0$ by applying the inverse relationship (applicable using either the exact equation, or by using an approximate method of digital calculation). The following equations summarise the above:

$$R_o(x(t)) = \frac{N \cdot i(t) - H_{fe}(\varphi(t))}{\varphi(t)} \quad [8]$$

$$R_0(x(t))=K_1[1-e^{-k_2 \cdot x(t)}+k_3 \cdot x(t)]+K_0 \quad [9]$$

$$x(t) = R_0^{-1}(R_o(x(t))) = R_0^{-1}\left(\frac{N \cdot i(t) - H_{fe}(\varphi(t))}{\varphi(t)}\right) \quad [10]$$

The constants $K_0$, $K_1$, $K_2$, $K_3$ are constants that can be obtained experimentally by means of a series of measurements of the magnetic circuit 14.

It will be appreciated from the above that the position x(t) of the oscillating arm 4 may be precisely calculated only when the value assumed by the flux Φ(t) is significantly non-zero, i.e. when at least one of the electromagnets 8 is excited; when both the electromagnets 8 are de-excited, it is not possible to calculate the position x(t) of the oscillating arm 4.

Figure 3:
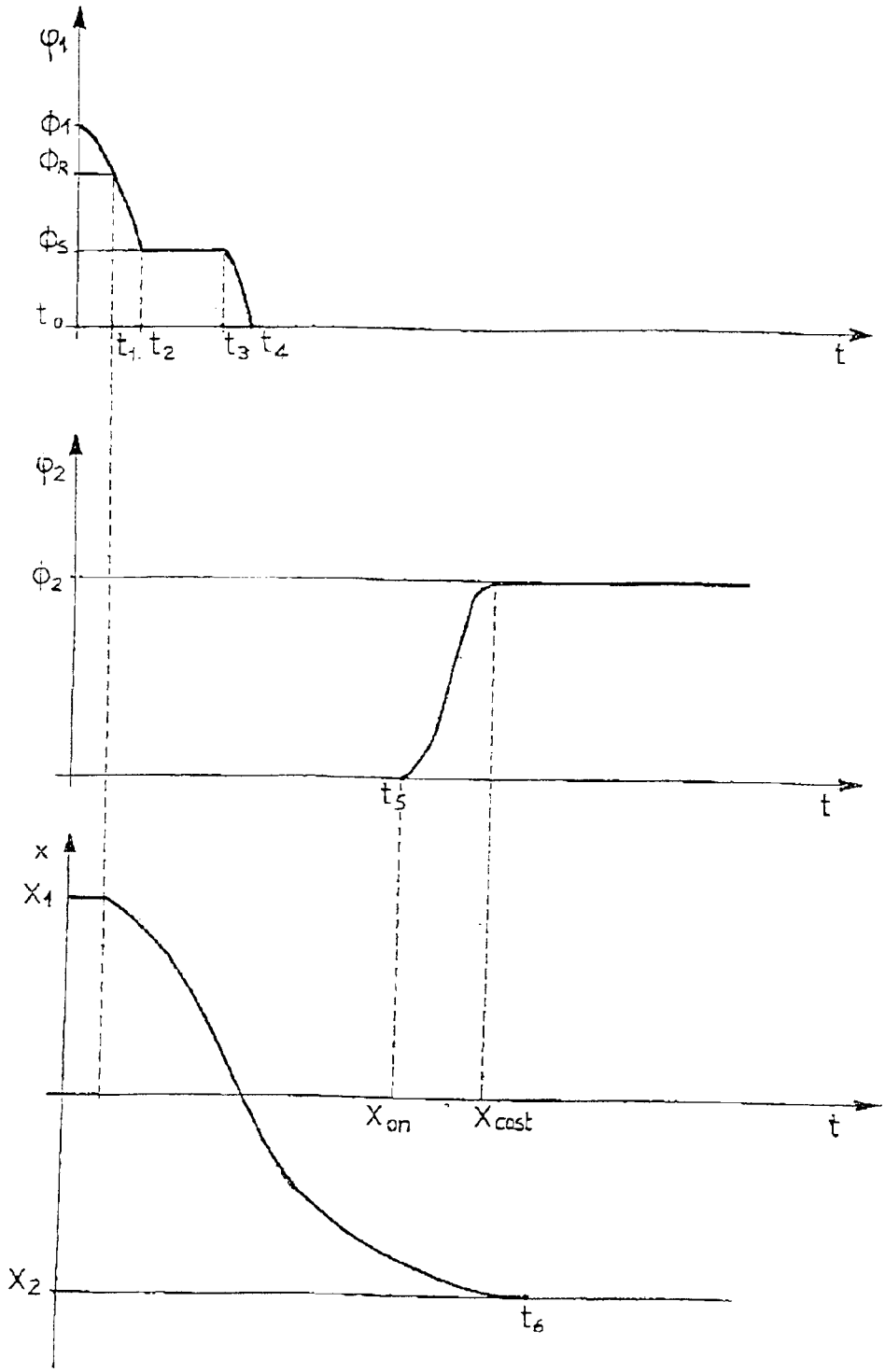
FIG. 3 shows graphs of the time curve of some magnitudes characteristic of the electromagnetic actuator of FIG. 1.

As shown in FIG. 3, at the time instant to the upper electromagnet 8 is excited, the lower electromagnet 8 is de-excited, and the oscillating arm 4 is immobile in a position of abutment against the upper electromagnet 8, which abutment position conventionally corresponds to a value $X_1$ of the position x(t) of the oscillating arm 4; the above-mentioned intermediate rest position corresponds to a zero value of the position x(t) of the oscillating arm 4, and the position of abutment against the lower electromagnet 8 corresponds to a value $X_2$ of the position x(t) of the oscillating arm 4. In order to displace the oscillating arm 4 from the position of abutment against the upper electromagnet 8 to the position of abutment against the lower electromagnet 8, i.e. in order to bring the valve 2 from the closed position to the position of maximum opening, the upper electromagnet 8 is de-excited and the lower electromagnet 8 is subsequently excited.

From the time instant $t_0$, the upper electromagnet 8 is partially de-excited by the control unit 11 by varying the excitation current i(t) supplied to the upper electromagnet 8, so as rapidly to reduce the magnetic flux Φ(t) generated by the upper electromagnet 8 from an operating value $\Phi_1$ to an estimated value $\Phi_S$, to maintain the flux Φ(t) at the estimated value $\Phi_S$ for an estimation time interval (included between the time instants $t_2$ e $t_3$), and lastly rapidly to zero-set the flux Φ(t). The estimated value $\Phi_S$ is lower than the value $\Phi_R$ which causes the oscillating arm 4 to be detached from the upper electromagnet 8; for this reason, from the time instant $t_1$, in which the flux Φ(t) becomes lower than the value $\Phi_R$ the oscillating arm 4 is detached from the upper electromagnet 8 and starts to move towards the lower electromagnet 8 as a result of the elastic force exerted by the spring 9.

During the estimation time interval, the control unit 11 estimates the mean value of the disturbance force $F_d$ acting on the valve 2 as a result of the action of the gases in the cylinder (not shown); in particular, the instantaneous value of the disturbance force $F_d$ at a sequence of N time intervals included in the estimation time interval (i.e. between the time instants $t_2$ e $t_3$) is estimated and the mean of the N instantaneous values is calculated by applying equation [11]:

$$F_{dmedia} = \frac{1}{N} \cdot \sum_{k=1}^{N} F_{dk} \quad [11]$$

In order to estimate the instantaneous value of the disturbance force $F_d$ at a kth instant in which the oscillating arm 4 is in the position $x_k$, equation [12], in which $L_d$ is the work performed by the disturbance force $F_d$, is applied:

$$F_{dk} = \frac{\Delta L_d}{\Delta x} = \frac{L_{dk} - L_{dk-1}}{x_{dk} - x_{dk-1}} \quad [12]$$

The work $L_d$ performed by the disturbance force $F_d$ during a predetermined time interval in which the oscillating arm 4 moves from an initial to a final position is calculated by applying equation [13]:

$$\Delta L_d = \Delta E_E - \Delta E_K - \Delta L_m - \Delta L_v = \frac{1}{2}\cdot k\cdot(x_f^2 - x_i^2) - \frac{1}{2}\cdot m\cdot(v_f^2 - v_i^2) - \int_{x_i}^{x_f} F_m(x)\cdot dx - \int_{x_i}^{x_f} F_b(x)\cdot dx \quad [13]$$

in which:

$L_d$ is the work performed by the disturbance force $F_d$;
$E_E$ is the elastic energy stored by the spring 9;
$E_k$ is the kinetic energy possessed by the oscillating arm 4;
$L_m$ is the value achieved by the electromagnetic force generated by the upper electromagnet 8;
$L_v$ is the work performed by the force of viscous friction;
m is the mass of the oscillating arm 4;
k is the elastic constant of the spring 9;
x is the instantaneous position of the oscillating arm 4;
$X_i$ is the initial position of the oscillating arm 4;
$X_f$ is the final position of the oscillating arm 4;
v is the instantaneous speed of the oscillating arm 4;
$v_i$ is the initial speed of the oscillating arm 4;
$v_f$ is the final speed of the oscillating arm 4;
$F_m$ is the electromagnetic force generated by the upper electromagnet 8;
$F_b$ is the force of viscous friction acting on the oscillating arm 4.

In particular, the value of the force of viscous friction $F_b$ acting on the oscillating arm 4 is calculated as the product of the instantaneous speed v(t) of the oscillating arm 4 and a coefficient of viscous friction which is constant or depends on temperature. During the estimation time interval, the value of the flux Φ(t) is constant and equal to the estimation value $\Phi_S$; during the estimation time interval, therefore, the electromagnetic force $F_m$ generated by the upper electromagnet 8 is calculated by equation [14]:

$$F_m(\varphi, x) = -\frac{1}{2}\cdot\frac{\partial R(x(t), \varphi(t))}{\partial x}\cdot\varphi^2(t) = \frac{1}{2}\cdot\Phi_s^2\cdot\frac{\partial R_0(x(t))}{\partial x} \quad [14]$$

It will be appreciated that the value of the position x(t) of the oscillating arm 4 during the estimation time interval is calculated by applying equation [10], while the value of the speed v(t) of the oscillating arm 4 during the estimation time interval is calculated by deriving the value of the position x(t) over time.

At the end of the estimation time interval, the upper electromagnet 8 is de-excited and, until the lower electromagnet 8 is activated, the control unit 11 manages to calculate the value of the position x(t) of the oscillating arm 4 by applying the equation [10]; moreover, the control unit 11 also has to know the development over time of the position x(t) of the oscillating arm 4 after the de-excitation of the upper electromagnet 8 in order accurately to determine the excitation parameters of the lower electromagnet 8 (intensity, duration and instant of commencement of the relative excitation current i(t)) in order to cause the oscillating arm 4 to impact against the lower electromagnet 8 at a substantially zero speed.

In order also to estimate the development over time of the position x(t) of the oscillating arm 4 after the de-excitation of the upper electromagnet 8, the control unit 11 uses a mathematical model of the mechanical system SM comprising the oscillating arm 4 and the spring 9, which mathematical model is summarised by equation [15]:

$$m*dv(t)/dt=k*(x(t)-X_0)-F_d(t)-F_b(t) \quad [15]$$

in which:

m is the mass of the oscillating arm 4;
v(t) is the speed of the oscillating arm 4;
x(t) is the position of the oscillating arm 4;
k is the elastic constant of the spring 9;
$X_0$ is the position of the oscillating arm 4 corresponding to the rest position of the spring 9;
$F_d(t)$ is the disturbance force;
$F_b(t)$ is the force of viscous friction.

In order to apply equation [15], the control unit 11 has to estimate the instantaneous value of the disturbance force $F_d$ acting on the valve 2 from the de-excitation excitation of the upper electromagnet 8 up to the excitation of the lower electromagnet 8 using the mean value of the disturbance force $F_d$ calculated during the estimation time interval; in particular, the control unit 11 assumes that the disturbance force $F_d$ has a linear course decreasing from the estimated mean value to the zero value respectively between the instant in which the upper electromagnet 8 is substantially cut off and the instant in which the oscillating arm 4 comes into abutment against the lower electromagnet 8.

The above-mentioned excitation parameters of the lower electromagnet 8 are calculated so as to supply the oscillating arm 4 with the mechanical energy that it lacks in order to reach the desired abutment position with a substantially zero speed of impact v(t), i.e. to provide the oscillating arm 4 with the energy dissipated during the displacement between the position of abutment against the upper electromagnet 8 and the position of abutment against the lower electromagnet 8.

In particular, the excitation parameters of the lower electromagnet 8 are calculated as a function of the estimate of the mean disturbance force $F_{dmedia}$ obtained by equation [11]; as the initial value of the mean disturbance force $F_{dmedia}$ is known and the model of development of the disturbance force $F_d$ is defined (as mentioned above, the control unit 11 assumes that the disturbance force $F_d$ has a linear course decreasing from the estimated mean value to the zero value respectively between the instant in which the upper electromagnet 8 is substantially cut off and the instant in which the oscillating arm 4 comes into abutment against the lower electromagnet 8), the work $L_d$ performed by the disturbance force $F_d$ can be readily obtained from equation [16] (in which $X_i$ is the initial position and $X_f$ is the final position of action of the disturbance force $F_d$):

$$L_d = \int_{X_i}^{X_f} F_d(x)dx \quad [16]$$

Assuming that the work performed by the lower electromagnet 8 offsets the work $L_d$ performed by the disturbance force $F_d$ provides equation [17]:

$$\alpha \cdot Ld = \int_{X_{ON}}^{X_{cost}} F_m(x, \varphi_2(x)) + \int_{X_{cost}}^{X_2} F_m(x, \phi_2) \quad [17]$$

in which:

$F_m$ is the force generated by the lower electromagnet 8 (see, for reference, equation [14]);

$\alpha$ is a control parameter;

$\phi_2$ is the constant value of magnetic flux $\Phi_2$ with which the lower electromagnet 8 normally operates;

$X_{on}$ is the position of the oscillating arm 4, at which the lower electromagnet 8 is activated;

$X_2$ is the final position of the oscillating arm 4, at which the oscillating arm 4 is in abutment against the lower electromagnet 8;

$X_{cost}$ is the position of the oscillating arm 4, at which the lower electromagnet 8 reaches and maintains the magnetic flux value $\phi_2$.

Resolving equation [17] makes it possible to obtain the values of the parameters $X_{on}$ and $\phi_2$ which characterise the excitation of the lower electromagnet 8.

The control parameter a is needed to optimise the successive phase of closed loop control of the lower electromagnet 8, so that when the oscillating arm 4 reaches the position of abutment against the lower electromagnet 8, the energy equilibrium defined by equation [18] (in which m is the mass of the oscillating arm 4 and $L_i$ are the works of the forces acting on the oscillating arm 4) occurs, i.e. the oscillating arm 4 impacts on the lower electromagnet 8 with a desired speed $V_f$:

$$\sum_i L_i = \frac{1}{2} m V_f^2 \quad [18]$$

According to a further embodiment, the excitation parameters of the lower electromagnet 8 are calculated as a function of the difference existing between an elastic energy $E_E$ statically stored by the spring 9 in the position of abutment against the lower electromagnet 8 (i.e. in the desired position) and the mechanical energy $E_M$ dynamically stored in the mechanical system SM; this mechanical energy $E_M$ is calculated by applying equation [19] and using the values of the position x(t) and the speed v(t) of the oscillating arm 4 provided by the resolution of equation [15]:

$$E_M(t) = E_E(t) + E_K(t) = \frac{1}{2} \cdot k \cdot (x^2(t) - X_0^2) + \frac{1}{2} \cdot m \cdot v^2(t) \quad [19]$$

in which:

m is the mass of the oscillating arm 4;

v(t) is the speed of the oscillating arm 4;

k is the elastic constant of the spring 9;

X0 is the position of the oscillating arm 4 corresponding to the rest position of the spring 9.

Obviously, when the lower electromagnet 8 is excited and in stable operation (i.e. at the end of an activation transient) it is possible to precisely to calculate, by applying equation [10], the position x(t) of the oscillating arm 4 and, therefore, to control in feedback the position x(t) and the speed v(t) of the oscillating arm 4 in order to try to obtain a substantially zero speed of impact against the lower electromagnet 8; however, the possibilities of final correction by means of the feedback control are relatively modest and, in order to be really efficient, have to be combined with the previous control of the excitation of the lower electromagnet 8 described above.

What is claimed is:

1. A control method for an electromagnetic actuator for the control of a valve of an engine from an abutment condition, in which abutment condition an actuator body actuating the valve and disposed to move between two electromagnets is maintained in abutment against a first excited electromagnet and against the action of at least one elastic body; in order to bring the actuator body into abutment against a second electromagnet, the first electromagnet is de-excited and the second electromagnet is subsequently excited, the method comprising the steps of measuring during the stage of de-excitation of the first electromagnet a mean value of the disturbance force acting on the valve;

calculating the excitation parameters of the second electromagnet as a function of the mean value of the disturbance force acting during the stage of de-excitation of the first electromagnet; and on the basis of the mean value of the disturbance force acting on the valve during the de-excitation stage of the first electromagnet, estimating the value of the disturbance force ($F_d$) up to the excitation of the second electromagnet:

wherein the excitation parameters of the second electromagnet are calculated in order to provide the actuator body with the mechanical energy that it lacks in order to reach the position of abutment against the second electromagnet with a substantially zero speed of impact; the actuator body is provided with the energy dissipated during the displacement between the position of abutment against the first electromagnet and the position of abutment against the second electromagnet;

and wherein the excitation parameters of the second electromagnet are calculated by assuming that the work performed by the second electromagnet offsets the work ($L_d$) performed by the disturbance force ($F_d$) according to the following equation:

$$\alpha \cdot Ld = \int_{X_{ON}}^{X_{cost}} F_m(x, \varphi_2(x)) + \int_{X_{cost}}^{X_2} F_m(x, \phi_2)$$

in which:

$L_d$ is the work performed by the disturbance force ($F_d$);

$F_m$ is the force generated by the second electromagnet;

$\alpha$ is a control parameter;

x is the position of the actuator body;

$\Phi_2$ is the magnetic flux of the second electromagnet;

$\phi_2$ is the constant value of magnetic flux with which the second electromagnet normally operates;

$X_{on}$ is the position of the actuator body, at which the second electromagnet is activated;

$X_2$ is the final position of the actuator body, at which the actuator body is in abutment against the second electromagnet;

$X_{cost}$ is the position of the actuator body, at which the second electromagnet reaches and maintains the magnetic flux value ($\phi_2$).

2. A method as claimed in claim 1, in which the disturbance force ($F_d$) has a linear course decreasing from the estimated mean value to the value respectively between the instant in which the first electromagnet is substantially cut off and the instant in which the actuator body comes into abutment against the second electromagnet.

3. A method as claimed in claim 1, in which the control parameter ($\alpha$) is calculated by assuming that the actuator body impacts against the second electromagnet at a desired speed ($V_f$) such that the sum of the works of the forces acting on the actuator body is equal to the kinetic energy possessed by the oscillating body.

4. A method as claimed in claim 1, in which a mechanical energy ($E_M$) dynamically stored in the mechanical system (SM) formed by the actuator body and the elastic body is estimated as a function of the disturbance force ($F_d$) and the excitation parameters of the second electromagnet are calculated as a function of the difference between an elastic energy ($E_E$) statically stored by the elastic body in the abutment position and the mechanical energy ($E_M$) dynamically stored in the mechanical system (SM).

5. A method as claimed in claim 4, in which, as a function of the disturbance force ($F_d$), a law of displacement of the actuator body during the stage between the de-excitation of the first electromagnet and the excitation of the second electromagnet is estimated, and the mechanical energy ($E_M$) dynamically stored in the mechanical system (SM) is estimated as a function of the law of displacement of the actuator body.

6. A method as claimed in claim 5, in which the law of displacement is estimated by means of a mathematical model of the mechanical system, which mathematical model makes provision for the action of the disturbance force ($F_d$).

7. A method as claimed in claim 6, in which the mathematical model makes provision for the action of a viscous friction acting on the actuator body.

8. A method as claimed in claim 7, in which the mathematical model is defined by the following equation:

$$m*dv(t)/dt=k*(x(t)-x_0)-F_d(t)-F_b(t)$$

in which:

m is the mass of the actuator body;

v(t) is the speed of the actuator body;

x(t) is the position of the actuator body;

k is the elastic constant of the elastic body;

$x_0$ is the position of the actuator body corresponding to the rest position of the elastic body;

$F_d(t)$ is the disturbance force;

$F_b(t)$ is the force of viscous friction.

9. A method as claimed in claim 1, in which the excitation parameters of each electromagnet comprise the value of the intensity, the value of the duration and the instant of commencement of the excitation current (i) which is supplied to the electromagnet.

10. A control method for an electromagnetic actuator for the control of a valve of an engine from an abutment condition, in which abutment condition an actuator body actuating the valve and disposed to move between two electromagnets is kept in abutment against a first excited electromagnet and against the action of at least one elastic body; in order to bring the actuator body into abutment against a second electromagnet, the first electromagnet is de-excited and the second electromagnet is subsequently excited, the method comprising the steps of measuring a mean value of the disturbance force ($F_d$) acting on the valve during a predetermined estimation time interval of the stage of de-excitation of the first electromagnet, keeping constant a magnetic flux ($\Phi$) generated by the first electromagnet at an estimated value ($\Phi_S$) determined during the estimation time interval, wherein the estimated value ($\Phi_S$) is lower than the value ($\Phi_R$) that causes the detachment of the actuator body from the first electromagnet.

11. A method as claimed in claim 10, in which the magnetic flux ($\Phi$) generated by the first electromagnet is rapidly decreased to the estimation value ($\Phi_S$), is kept constant and equal to the estimation value for the estimation time interval and is lastly rapidly decreased to a zero value.

12. A method as claimed in claim 10, in which the mean value of the disturbance force ($F_d$) is calculated by dividing the work ($L_d$) performed by the disturbance force ($F_d$) during a predetermined interval of time by the displacement performed by the actuator body in the same interval of time.

13. A method as claimed in claim 10, in which the mean value of the disturbance force ($F_d$) is calculated by determining the mean of a series of instantaneous values of the disturbance force ($F_d$); each instantaneous value of the disturbance force ($F_d$) is calculated by dividing the work ($L_d$) performed by the disturbance force ($F_d$) during a predetermined time interval by the displacement performed by the actuator body in the same time interval.

14. A method as claimed in claim 12, in which the work ($L_d$) performed by the disturbance force ($F_d$) during a predetermined time interval in which the actuator body moves from an initial to a final position is determined by applying the following equation:

$$\begin{aligned}\Delta L_d &= \Delta E_E - \Delta E_K - \Delta L_m - \Delta L_v = \\ &= \frac{1}{2}\cdot k\cdot(x_f^2 - x_i^2) - \frac{1}{2}\cdot m\cdot(v_f^2 - v_i^2) - \\ &\quad \int_{x_i}^{x_f} F_m(x)\cdot dx - \int_{x_i}^{x_f} F_b(x)\cdot dx\end{aligned}$$

in which:

$L_d$ is the work performed by the disturbance force;

$E_E$ is the elastic energy stored by the elastic body;

$E_k$ is the kinetic energy possessed by the actuator body;

$L_m$ is the value achieved by the electromagnetic force generated by the first electromagnet;

$L_v$ is the work performed by the force of viscous friction;

m is the mass of the actuator body;

k is the elastic constant of the elastic body;

x is the instantaneous position of the actuator body;

$x_i$ is the initial position of the actuator body;

$x_f$ is the final position of the actuator body;

v is the instantaneous speed of the actuator body;

$v_i$ is the initial speed of the actuator body;

$v_f$ is the final speed of the actuator body;

$F_m$ is the electromagnetic force generated by the first electromagnet;

$F_b$ is the force of viscous friction.

15. A method as claimed in claim 14, in which the force of viscous friction is calculated as the product of the instantaneous speed of the actuator body and a constant coefficient of viscous friction.

16. A method as claimed in claim 14, in which the electromagnetic force is calculated by means of the following equation:

$$F_m(\varphi, x) = \frac{1}{2} \cdot \Phi_s^2 \cdot \frac{\partial R_0(x(t))}{\partial x}$$

in which:

$F_m$ is the electromagnetic force;

$\Phi_S$ is the estimated value of the magnetic flux;

$R_0$ is the air gap reluctance of the magnetic circuit associated with the first electromagnet;

x is the instantaneous position of the actuator body.

17. A control method for an electromagnetic actuator for the control of a valve of an engine from an abutment condition, in which abutment condition an actuator body actuating the valve and disposed to move between two electromagnets is maintained in abutment against a first excited electromagnet and against the action of at least one elastic body; in order to bring the actuator body into abutment against a second electromagnet, the first electromagnet is de-excited and the second electromagnet is subsequently excited, the method comprising the steps of measuring during the stage of de-excitation of the first electromagnet a mean value of the disturbance force ($F_d$) acting on the valve and calculating the excitation parameters of the second electromagnet as a function of the mean value of the disturbance force ($F_d$) acting during the stage of de-excitation of the first electromagnet; the mean value of the disturbance force ($F_d$) being calculated during a predetermined estimation time interval of the stage of de-excitation of the first electromagnet and being calculated by dividing the work ($L_d$) performed by the disturbance force during a predetermined period of time by the displacement performed by the actuator body during this same period of time.

18. A method as claimed in claim 17, in which the work ($L_d$) performed by the disturbance force ($F_d$) during a predetermined time interval in which the actuator body moves from an initial to a final position is calculated by applying the following equation:

$$\begin{aligned}\Delta L_d &= \Delta E_E - \Delta E_K - \Delta L_m - \Delta L_v = \\ &= \frac{1}{2} \cdot k \cdot (x_f^2 - x_i^2) - \frac{1}{2} \cdot m \cdot (v_f^2 - v_i^2) - \\ &\quad \int_{x_i}^{x_f} F_m(x) \cdot dx - \int_{x_i}^{x_f} F_b(x) \cdot dx\end{aligned}$$

in which:

$L_d$ is the work performed by the disturbance force;

$E_E$ is the elastic energy stored by the elastic body;

$E_k$ is the kinetic energy possessed by the actuator body;

$L_m$ is the value achieved by the electromagnetic force generated by the first electromagnet;

$L_v$ is the work performed by the force of viscous friction;

m is the mass of the actuator body;

k is the elastic constant of the elastic body;

x is the instantaneous position of the actuator body;

$x_i$ is the initial position of the actuator body;

$x_f$ is the final position of the actuator body;

v is the instantaneous speed of the actuator body;

$v_i$ is the initial speed of the actuator body;

$v_f$ is the final speed of the actuator body;

$F_m$ is the electromagnetic force generated by the first electromagnet;

$F_b$ is the force of viscous friction.

19. A method as claimed in claim 18, in which the force of viscous friction is calculated as the product of the instantaneous speed of the actuator body and a constant coefficient of viscous friction.

20. A method as claimed in claim 18, in which the electromagnetic force is calculated by means of the following equation:

$$F_m(\varphi, x) = \frac{1}{2} \cdot \Phi_s^2 \cdot \frac{\partial R_0(x(t))}{\partial x}$$

in which:

$F_m$ is the electromagnetic force;

$\Phi_S$ is the estimated value of the magnetic flux;

$R_0$ is the air gap reluctance of the magnetic circuit associated with the first electromagnet;

x is the instantaneous position of the actuator body.

21. A control method for an electromagnetic actuator for the control of a valve of an engine from an abutment condition, in which abutment condition an actuator body actuating the valve and disposed to move between two electromagnets is maintained in abutment against a first excited electromagnet and against the action of at least one elastic body; in order to bring the actuator body into abutment against a second electromagnet, the first electromagnet is de-excited and the second electromagnet is subsequently excited, the method comprising the steps of measuring during the stage of de-excitation of the first electromagnet of a mean value of the disturbance force ($F_d$) acting on the valve and calculating the excitation parameters of the second electromagnet as a function of the mean value of the disturbance force ($F_d$) acting during the stage of de-excitation of the first electromagnet; the mean value of the disturbance force ($F_d$) being calculated during a predetermined estimation time interval of the stage of de-excitation of the first electromagnet, and being calculated by determining the mean of a series of instantaneous values of the disturbance force ($F_d$), each instantaneous value of the disturbance force ($F_d$) being determined by dividing the work ($L_d$) performed by the disturbance force during a predetermined time interval by the displacement performed by the actuator body in the same time interval.

22. A method as claimed in claim 21, in which the work ($L_d$) performed by the disturbance force ($F_d$) during a predetermined time interval in which the actuator body moves from an initial to a final position is calculated by applying the following equation:

$$\begin{aligned}\Delta L_d &= \Delta E_E - \Delta E_K - \Delta L_m - \Delta L_v = \\ &= \frac{1}{2} \cdot k \cdot (x_f^2 - x_i^2) - \frac{1}{2} \cdot m \cdot (v_f^2 - v_i^2) - \\ &\quad \int_{x_i}^{x_f} F_m(x) \cdot dx - \int_{x_i}^{x_f} F_b(x) \cdot dx\end{aligned}$$

in which:

$L_d$ is the work performed by the disturbance force;

$E_E$ is the elastic energy stored by the elastic body;

$E_k$ is the kinetic energy possessed by the actuator body;

$L_m$ is the value achieved by the electromagnetic force generated by the first electromagnet;

$L_v$ is the work performed by the force of viscous friction;

m is the mass of the actuator body;

k is the elastic constant of the elastic body;

x is the instantaneous position of the actuator body;

$x_i$ is the initial position of the actuator body;

$x_f$ is the final position of the actuator body;

v is the instantaneous speed of the actuator body;

$v_i$ is the initial speed of the actuator body;

$v_f$ is the final speed of the actuator body;

$F_m$ is the electromagnetic force generated by the first electromagnet;

$F_b$ is the force of viscous friction.

23. A method as claimed in claim 21, in which the force of viscous friction is calculated as the product of the instantaneous speed of the actuator body and a constant coefficient of viscous friction.

24. A method as claimed in claim 21, in which the electromagnetic force is calculated by means of the following equation:

$$F_m(\varphi, x) = \frac{1}{2} \cdot \Phi_s^2 \cdot \frac{\partial R_0(x(t))}{\partial x}$$

in which:

$F_m$ is the electromagnetic force;

$\Phi_S$ is the estimated value of the magnetic flux;

$R_0$ is the air gap reluctance of the magnetic circuit associated with the first electromagnet;

x is the instantaneous position of the actuator body.

25. A control method for an electromagnetic actuator for the control of a valve of an engine from an abutment condition, in which abutment condition an actuator body actuating the valve and disposed to move between two electromagnets is maintained in abutment against a first excited electromagnet and against the action of at least one elastic body; in order to bring the actuator body into abutment against a second electromagnet, the first electromagnet is de-excited and the second electromagnet is subsequently excited, the method comprising the steps of measuring during the stage of de-excitation of the first electromagnet a mean value of the disturbance force acting on the valve, and calculating the excitation parameters of the second electromagnet as a function of the mean value of the disturbance force acting during the stage of de-excitation of the first electromagnet;

wherein the mean value of the disturbance force ($F_d$) is calculated during a predetermined estimation time interval of the stage of de-excitation of the first electromagnet;

and wherein a magnetic flux ($\Phi$) generated by the first electromagnet is kept constant at an estimated value ($\Phi_S$) calculated during the estimation time interval, this estimated value ($\Phi_S$) being lower than a value ($\Phi_R$) which causes the detachment of the actuator body from the first electromagnet.

26. A method as claimed in claim 25, in which the magnetic flux ($\Phi$) generated by the first electromagnet is rapidly decreased to the estimated value ($\Phi_S$), is kept constant and equal to the estimated value ($\Phi_S$) for the estimation time interval and is lastly rapidly decreased to a zero value.

* * * * *